US009412289B2

(12) United States Patent
Jinta et al.

(10) Patent No.: US 9,412,289 B2
(45) Date of Patent: Aug. 9, 2016

(54) DISPLAY UNIT, DRIVE CIRCUIT, DRIVE METHOD, AND ELECTRONIC APPARATUS

(71) Applicant: Sony Corporation, Tokyo (JP)

(72) Inventors: Seiichiro Jinta, Kanagawa (JP); Akira Yumoto, Kanagawa (JP); Takahiro Seki, Tokyo (JP)

(73) Assignee: Sony Corporation, Tokyo (JP)

( * ) Notice: Subject to any disclaimer, the term of this patent is extended or adjusted under 35 U.S.C. 154(b) by 194 days.

(21) Appl. No.: 13/935,018

(22) Filed: Jul. 3, 2013

(65) Prior Publication Data

US 2014/0035974 A1 Feb. 6, 2014

(30) Foreign Application Priority Data

Jul. 31, 2012 (JP) ..... 2012-170486

(51) Int. Cl.
*G09G 3/32* (2016.01)
*G09G 3/02* (2006.01)

(52) U.S. Cl.
CPC ..... *G09G 3/02* (2013.01); *G09G 3/3225* (2013.01); *G09G 2320/043* (2013.01)

(58) Field of Classification Search
CPC ..... G09G 2300/0202
See application file for complete search history.

(56) References Cited

U.S. PATENT DOCUMENTS

2006/0279478 A1* 12/2006 Ikegami ..... 345/30

FOREIGN PATENT DOCUMENTS

| | | | |
|---|---|---|---|
| JP | 2005-228459 | | 8/2005 |
| JP | 2009-204664 | | 9/2009 |
| JP | 2009204664 A | * | 9/2009 |
| JP | 2009-252269 | | 10/2009 |
| JP | 2010-002796 | | 1/2010 |
| JP | 2010-281993 | | 12/2010 |

* cited by examiner

*Primary Examiner* — Quan-Zhen Wang
*Assistant Examiner* — Chad Dicke
(74) *Attorney, Agent, or Firm* — Michael Best & Friedrich LLP

(57) ABSTRACT

A display unit that drives pixels field sequentially includes pixel circuits disposed in a matrix form of rows and columns and a drive control section that causes the pixel circuits to display image frames of input image data such that a single frame of the image frames is displayed in two parts as a first sub-frame and as a second sub-frame. The first and second sub-frames are displayed field sequentially by different portions of the pixel circuits. The first sub-frame is displayed by a first portion of the pixel circuits that are located in a checked pattern, while the second sub-frame is displayed by the remaining pixel circuits.

17 Claims, 12 Drawing Sheets

DISPLAY UNIT, DRIVE CIRCUIT, DRIVE METHOD, AND ELECTRONIC APPARATUS

BACKGROUND

The present disclosure relates to a display unit having a current-drive display element, a drive circuit for use in such a display unit, and an electronic apparatus including such a display unit.

In a field of a display unit that performs image display, there has been developed and commercialized in recent years a display unit (such as an organic EL display unit) including, as a light-emitting element, a current-drive optical element that emits light of which the luminance varies depending on an applied current value (such as an organic electro luminescence (EL) element). Unlike a liquid crystal element, etc., the organic EL element is a self-luminous light-emitting element and hence provision of a light source (backlight) is not necessary. The organic EL display unit therefore has features of high image viewability, low power consumption, and fast response compared with a liquid crystal display unit which indispensably includes a light source.

Such display unit that includes the current-drive optical element has a display section having pixels arranged in a matrix, and various circuits used for driving the display section in the periphery of the display section. Specifically, for example, a source-driver circuit that supplies a pixel signal to each pixel, a write scan circuit that selects a pixel line through which the pixel signal is supplied, and a power supply scan circuit that supplies power to each pixel are provided in the periphery of the display section, (for example, see Japanese Unexamined Patent Application Publication Nos. 2010-2796, 2010-281993, 2009-2522269, and 2005-228459).

In the display unit, a so-called bezel region in the periphery of the display section is desired to be reduced mainly from the viewpoint of design. For example, Japanese Unexamined Patent Application Publication No. 2009-204664 proposes a display unit in which two pixels being horizontally adjacent to each other share one pixel signal line (data line) to reduce a circuit scale of a source driver, thereby achieving a narrow bezel region.

SUMMARY

In general, improvement in image quality is demanded for display units, and therefore suppression of a reduction in image quality is expected also when reducing the bezel region as described above.

It is desirable to provide a display unit, a drive circuit, a drive method, and an electronic apparatus capable of suppressing a reduction in image quality.

According to one exemplary illustration of the subject matter of the disclosure, a display unit may include a plurality of pixel circuits disposed in a matrix form comprising rows and columns, and a drive control section configured to cause the plurality of pixel circuits to display image frames corresponding to input image data such that a given frame of the image frames is displayed as a first sub-frame and as a second sub-frame. Further, the first sub-frame may be displayed by a portion of the plurality of pixel circuits comprising a checked pattern including every other pixel circuit in each row and every other pixel circuit in each column, such that each pixel circuit displaying the first sub-frame begins display thereof during a first half of a given frame period, and the second sub-frame may be displayed by those of the plurality of pixel circuits that do not display the first sub-frame, such that each pixel circuit displaying the second sub-frame begins display thereof during a second half of the given frame period.

The display unit may further include a plurality of write scanning lines and a plurality of signal lines. Further, each of the plurality of pixel circuits may include a display element, a first transistor configured to sample a potential carried on one of the plurality of signal lines when a scanning pulse is applied to one of the plurality of write scanning lines, which is connected to the first transistor, a capacitor with a first terminal configured to hold the potential sampled by the first transistor, and a second transistor configured to supply a drive current to the display element, the magnitude of the drive current corresponding to a voltage between the first terminal of the capacitor and a second terminal of the capacitor.

Further, the plurality of pixel circuits may be grouped into pairs of pixel circuits such that each of the pairs of pixel circuits includes two pixel circuits that are adjacent to each other in a same row and that are connected to a same one of the plurality of signal lines. For each of the pairs of pixel circuits, one pixel circuit of the respective pair of pixel circuits may display the first sub-frame and the other pixel circuit of the respective pair of pixel circuits may display the second sub-frame.

Further, the plurality of write scanning lines may be grouped into a first group and a second group, and for each of the pairs of pixel circuits, the one of the pixel circuits included in the respective pair of pixel circuits that displays the first sub-frame may be connected to a write scanning line of the first group, and the other one of the pixel circuits included in the respective pair of pixel circuits, which displays the second sub-frame, may be connected to a write scanning line of the second group.

Further, for each row of the plurality of pixel circuits, pixel circuits located at even-numbered column positions of the row may be each connected to a same one of the plurality of write scanning lines as each other and pixel circuits located at odd-numbered column positions of the row may be each connected to a same one of the plurality of write scanning lines as each other that is different from the one of the plurality of write scanning lines to which the pixel circuits located at the even-numbered column positions of the row are connected.

Further, for a given column of the plurality of pixel circuits, pixel circuits located at even-numbered row positions of the given column may be connected to write scanning lines of the first group and pixel circuits located at odd-numbered row positions of the column may be connected to write scanning lines of the second group.

Further, the plurality of pixel circuits may be configured to perform, under control of the drive control section, a threshold correction operation that results in storing a threshold voltage of the second transistor of the respective one of the plurality of pixel circuit in the capacitor of the respective one of the plurality of pixel circuit.

Further, the drive control section may be configured to cause a given pixel circuit of the plurality of pixel circuits to perform the threshold correction operation by causing the first transistor of the given pixel circuit to be in a conductive state while a reference potential may be carried on the signal line connected to the given pixel circuit and while a drive voltage may be applied to the second transistor of the given pixel circuit.

Further, the threshold correction operation may be performed simultaneously for all of those of the plurality of pixel circuits disposed in a same row.

According to another exemplary illustration of the subject matter of the disclosure, a display unit may include plurality of write scanning lines, a plurality of signal lines, and a plurality of pixel circuits disposed in a matrix form comprising rows and columns. The plurality of pixel circuits may be grouped into pairs of pixel circuits such that each of the pairs of pixel circuits includes two pixel circuits that may be adjacent to each other in a same row and that may be connected to a same one of the plurality of signal lines, and for each of the pairs of pixel circuits, one of the pixel circuits included in the pair of pixel circuits may be connected to one of the plurality of write scanning lines and the other one of the pixel circuits included in the pair of pixel circuits may be connected to a different one of the plurality of write scanning lines.

Further, each of the plurality of pixel circuits may include a display element, a first transistor configured to sample a potential carried on one of the plurality of signal lines when a scanning pulse may be applied to one of the plurality of write scanning lines, which may be connected to the first transistor, a capacitor with a first terminal configured to hold the potential sampled by the first transistor, and a second transistor configured to supply a drive current to the display element, the magnitude of the drive current corresponding to a voltage between the first terminal of the capacitor and a second terminal of the capacitor.

Further, the display unit may include a drive control section configured to cause the plurality of pixel circuits to display image frames corresponding to input image data such that a given frame of the image frames may be displayed as a first sub-frame and as a second sub-frame. The plurality of write scanning lines may be grouped into a first group and a second group, such that, for each of the pairs of pixel circuits, one of the pixel circuits included in the respective pair of pixel circuits may be connected to a write scanning line of the first group and the other one of the pixel circuits included in the respective pair of pixel circuits may be connected to a write scanning line of the second group. The first sub-frame may be displayed by those of the plurality of pixel circuits connected to scanning lines of the first group, such that each pixel circuit displaying the first sub-frame begins display thereof during a first half of a given frame period, and the second sub-frame may be displayed by those of the plurality of pixel circuits connected to scanning lines of the second group, such that each pixel circuit displaying the second sub-frame begins display thereof during a second half of the given frame period.

Further, for each row of the plurality of pixel circuits, pixel circuits located at even-numbered column positions of the row may be each connected to a same one of the plurality of write scanning lines as each other and pixel circuits located at odd-numbered column positions of the row may be each connected to a same one of the plurality of write scanning lines as each other that may be different from the one of the plurality of write scanning lines to which the pixel circuits located at the even-numbered column positions of the row may be connected.

Further, for a given column of the plurality of pixel circuits, pixel circuits located at even-numbered row positions of the given column may be connected to write scanning lines of the first group and pixel circuits located at odd-numbered row positions of the column may be connected to write scanning lines of the second group.

Further, the plurality of pixel circuits may be configured to perform, under control of the drive control section, a threshold correction operation that results in storing a threshold voltage of the second transistor of the respective one of the plurality of pixel circuit in the capacitor of the respective one of the plurality of pixel circuit.

Further, the drive control section may be configured to cause a given pixel circuit of the plurality of pixel circuits to perform the threshold correction operation by causing the first transistor of the given pixel circuit to be in a conductive state while a reference potential may be carried on the signal line connected to the given pixel circuit and while a drive voltage may be applied to the second transistor of the given pixel circuit.

Further, the threshold correction operation may be performed simultaneously for all of those of the plurality of pixel circuits disposed in a same row.

Further, the drive control section may be configured to cause the plurality of pixel circuits to display image frames corresponding to input image data such that such that a given frame of the image frames may be displayed during a given frame period as a first sub-frame and as a second sub-frame. During a first half of the given frame period, in which video signal potentials corresponding to the first sub-frame may be carried on the signal lines, for each of the pairs of pixel circuits, only one of the pixel circuits included in the respective pair of pixel circuits samples a video signal potential corresponding to a display gradation. During a second half of the given frame period, in which video signal potentials corresponding to the second sub-frame may be carried on the signal lines, for each of the pairs of pixel circuits, the one of the pixel circuits included in the respective pair of pixel circuits that did not sample a video signal potential corresponding to a display gradation during the first half of the given frame period samples a video signal potential corresponding to a display gradation.

Further, the plurality of write scanning lines may be grouped into a first group and a second group, such that, for each of the pairs of pixel circuits, one of the pixel circuits included in the respective pair of pixel circuits may be connected to a write scanning line of the first group and the other one of the pixel circuits included in the respective pair of pixel circuits may be connected to a write scanning line of the second group. Those of the plurality of pixel circuits connected to scanning lines of the first group may sample video signal potential corresponding to display gradations during the first half of the given frame period, and those of the plurality of pixel circuits connected to scanning lines of the second group may sample video signal potential corresponding to display gradations during the second half of the given frame period.

Further, the display unit may include a drive control section configured to cause the plurality of pixel circuits to display image frames corresponding to input image data such that a given frame of the image frames may be displayed as a first sub-frame and as a second sub-frame. Only a first portion of the plurality of pixel circuits comprising a checked pattern may be caused to display during a first part of a given frame period, and those of the plurality of pixel circuits that do not display during the first half of the given frame period may be caused to display during a second part of the given frame period.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Hereinafter, an embodiment of the disclosure will be described in detail with reference to the accompanying drawings. It is to be noted that description is made in the following order.

1. Embodiment
2. Application Examples

1. Embodiment

Exemplary Configuration

Figure 1:
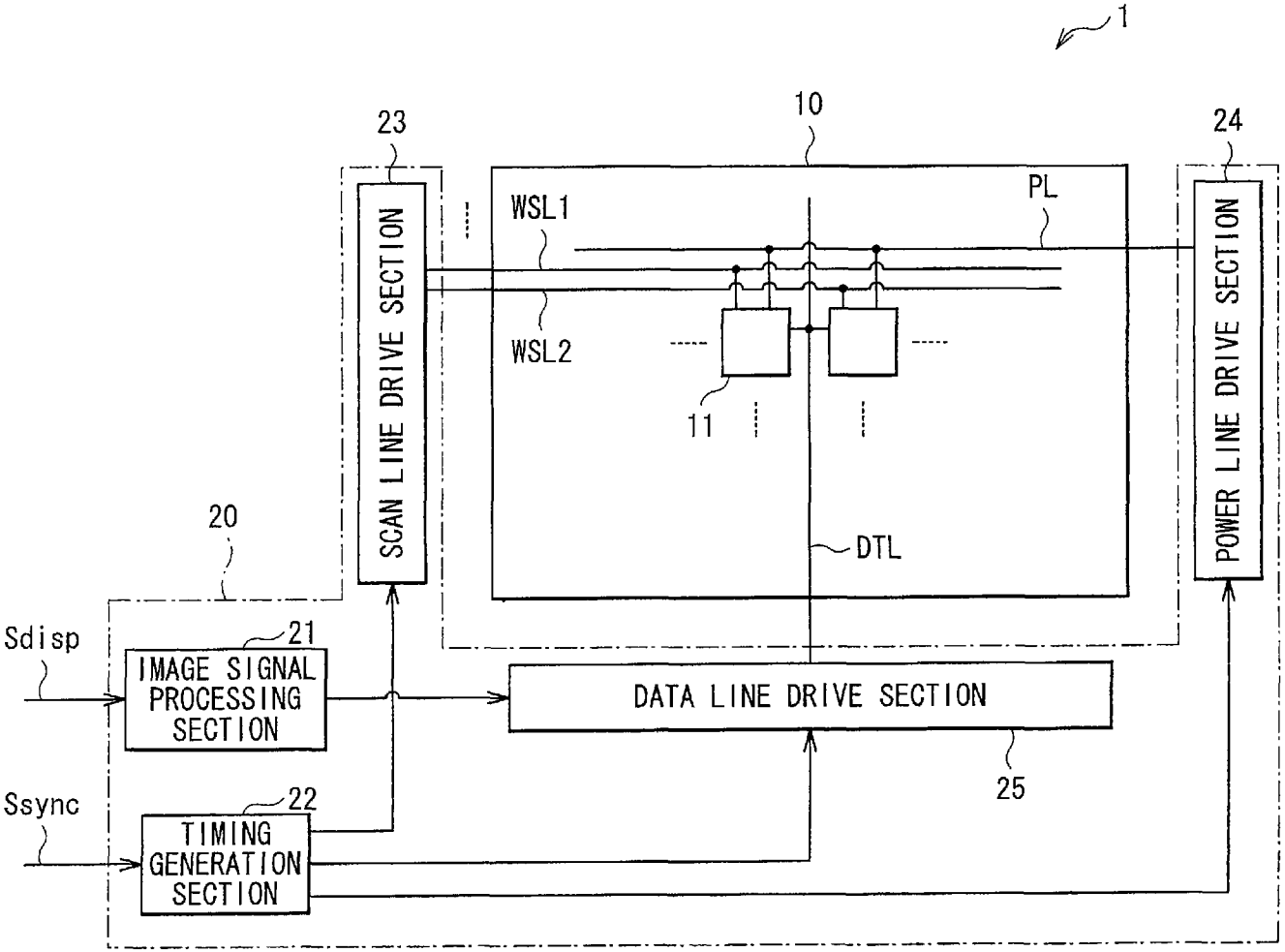
FIG. 1 is a block diagram illustrating an exemplary configuration of a display unit according to an embodiment of the disclosure.

FIG. 1 illustrates an exemplary configuration of a display unit according to an embodiment of the disclosure. The display unit 1 may be an active-matrix display unit using organic EL elements. Since a drive circuit according to an embodiment of the disclosure is embodied by the present embodiment, the drive circuit is described together. The display unit 1 includes a display section 10 and a drive section 20.

The display section 10 includes a plurality of pixels 11 arranged in a matrix. The display section 10 further includes a plurality of scan lines WSL1 and WSL2 and a plurality of power lines PL, each line extending in a row direction, and a plurality of data lines DTL extending in a column direction. Each of the scan lines WSL1 and WSL2, the power lines PL, and the data lines DTL is connected at one end thereof to the drive section 20. Each of the above-described pixels 11 is disposed at an intersection of the scan line WSL1 or WSL2 and the data line DTL. In the following, the term "scan line WSL" is used where appropriate to denote one of the scan lines WSL1 and WSL2.

Figure 2:
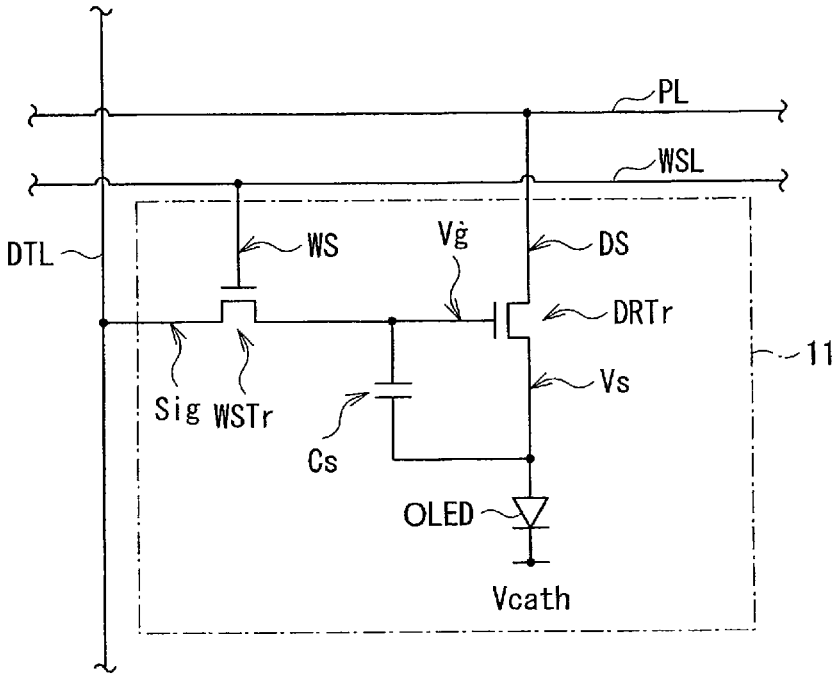
FIG. 2 is a circuit diagram illustrating an exemplary configuration of a pixel illustrated in FIG. 1.

FIG. 2 illustrates an exemplary configuration of the pixel 11. The pixel 11 includes a write transistor WSTr, a drive transistor DRTr, an organic EL element OLED, and a capacitor Cs. Specifically, in this exemplary case, the pixel 11 has a configuration of so-called "2Tr1C" including two transistors (the write transistor WSTr and the drive transistor DRTr) and one capacitor Cs.

Each of the write transistor WSTr and the drive transistor DRTr may be configured of, for example, a thin-film transistor (TFT) of an N-channel metal oxide semiconductor (MOS) type. The write transistor WSTr has a gate connected to the scan line WSL, a source connected to the data line DTL, and a drain connected to a gate of the drive transistor DRTr and a first end of the capacitor Cs. The drive transistor DRTr has a gate connected to the drain of the write transistor WSTr and the first end of the capacitor Cs, a drain connected to the power line PL, and a source connected to a second end of the capacitor Cs and an anode of the organic EL element OLED. It is to be noted that there is no particular limitation on a type of the TFT. For example, the TFT may have an inversely-staggered structure (so-called bottom gate type), a staggered structure (so-called top gate type), or the like.

The first end of the capacitor Cs may be connected to, for example, the gate of the drive transistor DRTr, and the second end thereof may be connected to, for example, the source of the drive transistor DRTr. The organic EL element OLED is a light-emitting element that emits light of a color (such as red, green, or blue) corresponding to each pixel 11, of which the anode is connected to the source of the drive transistor DRTr and the second end of the capacitor Cs, and the cathode receives a cathode voltage Vcath supplied form the drive section 20.

Figure 3:
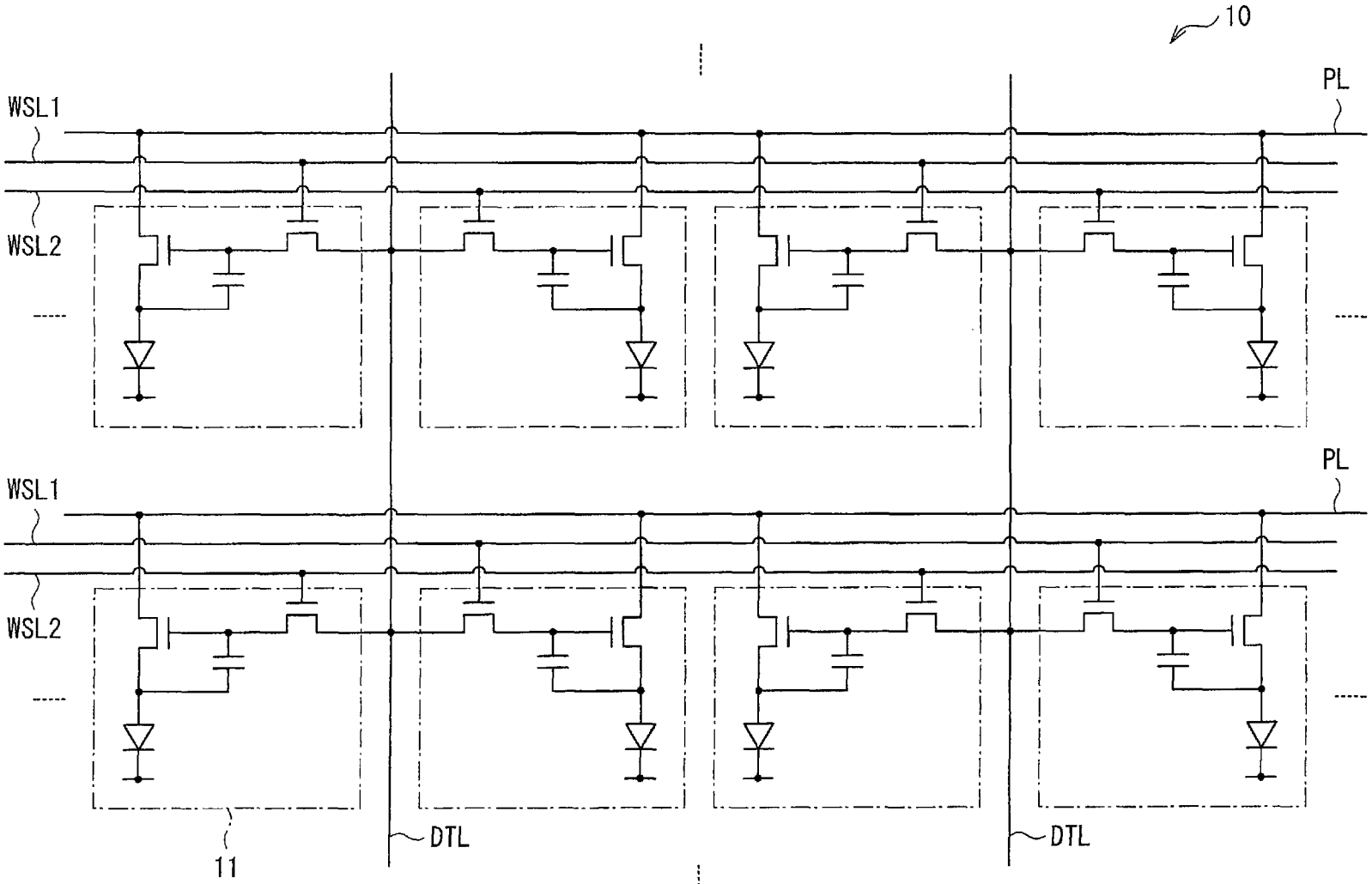
FIG. 3 is a circuit diagram illustrating exemplary connection between pixels illustrated in FIG. 1.

FIG. 3 illustrates connection between the pixels 11 of the display section 10. In the display section 10, each data line DTL is shared by two pixels 11 adjacent to each other in a row direction (horizontal direction). As a result, in the display unit 1, the number of data lines DTL is reduced, which allows a reduction in circuit scale of a data line drive section 25 (described later) of the drive section 20, resulting in a reduction in bezel region. Moreover, in the display section 10, one of the pixels 11 adjacent to each other in the row direction is connected to the scan line WSL1, while the other is connected to the scan line WSL2. Furthermore, in the display section 10, one of the pixels 11 adjacent to each other in the column direction (vertical direction) is connected to the scan line WSL1, while the other is connected to the scan line WSL2.

The drive section 20 drives the display section 10 based on a display signal Sdisp and a synchronizing signal Ssync which are supplied from outside. As illustrated in FIG. 1, the drive section 20 may include a display signal processing section 21, a timing generation section 22, a scan line drive section 23, a power line drive section 24, and a data line drive section 25.

The display signal processing section 21 performs predetermined signal processing on the display signal Sdisp supplied from the outside to generate a display signal Sdisp2. Examples of the predetermined signal processing may include gamma correction and overdrive correction.

The timing generation section 22 is a circuit that, in response to the synchronizing signal Ssync supplied from the outside, supplies a control signal to each of the scan line drive section 23, the power line drive section 24, and the data line drive section 25 such that these sections operate in synchronization with one another.

In response to the control signal supplied from the timing generation section 22, the scan line drive section 23 sequentially applies scan signals WS1 to the plurality of scan lines WSL1, and sequentially applies scan signals WS2 to the plurality of scan lines WSL2 to sequentially select the pixels 11 for each row.

In response to the control signal supplied from the timing generation section 22, the power line drive section 24 sequentially applies power line signals DS to the plurality of power lines PL to control light-emitting operation and extinction operation of the pixels 11 for each row. The power line signals DS each make a transition from a voltage Vccp to a voltage Vini and vice versa. As described later, the voltage Vini is a voltage for initialization of the pixel 11, and the voltage Vccp is a voltage for causing a current to flow through the drive transistor DRTr to induce light emission of the organic EL element OLED.

In response to the display signal Sdisp2 supplied from the display signal processing section 21 and the control signal supplied from the timing generation section 22, the data line drive section 25 generates a signal Sig containing a pixel voltage. Vsig that instructs luminance of emission light of each pixel 11, and applies the signal Sig to each data line DTL.

The scan lines WSL1 correspond to a specific but not limitative example of "first-group scan lines" in one embodiment of the disclosure. The scan lines WSL2 correspond to a specific but not limitative example of "second-group scan lines" in one embodiment of the disclosure. The data line DTL corresponds to a specific but not limitative example of "pixel signal line" in one embodiment of the disclosure. The organic EL element OLED corresponds to a specific but not limitative example of "display element" in one embodiment of the disclosure. The drive transistor DRTr corresponds to a specific but not limitative example of "first transistor" in one embodiment of the disclosure. The write transistor WSTr corresponds to a specific but not limitative example of "second transistor" in one embodiment of the disclosure.

Operation and Functions

Operation and functions of the display unit 1 according to the present embodiment are now described.

Summary of Overall Operation

First, summary of overall operation of the display unit 1 is described with reference to FIG. 1. The display signal processing section 21 performs predetermined signal processing on the display signal Sdisp supplied from the outside to generate the display signal Sdisp2. In response to the synchronizing signal Ssync supplied from the outside, the timing generation section 22 supplies the control signal to each of the scan line drive section 23, the power line drive section 24, and the data line drive section 25 such that these sections operate in synchronization with one another. In response to the control signal supplied from the timing generation section 22, the scan line drive section 23 sequentially applies the scan signals WS1 to the plurality of scan lines WSL1, and sequentially applies the scan signals WS2 to the plurality of scan lines WSL2 to sequentially select the pixels 11 for each row. In response to the control signal supplied from the timing generation section 22, the power line drive section 24 sequentially applies the power line signals DS to the plurality of power lines PL to control light-emitting operation and extinction operation of the pixels 11 for each row. In response to the display signal Sdisp2 supplied from the display signal processing section 21 and the control signal supplied from the timing generation section 22, the data line drive section 25 generates the signal Sig that contains the pixel voltage Vsig corresponding to luminance of emission light of each pixel 11, and applies the signal Sig to each data line DTL. The display section 10 performs display in response to the scan signals WS1 and WS2, the power line signals DS, and the signal Sig supplied from the drive section 20.

Detailed Operation

Figure 4:
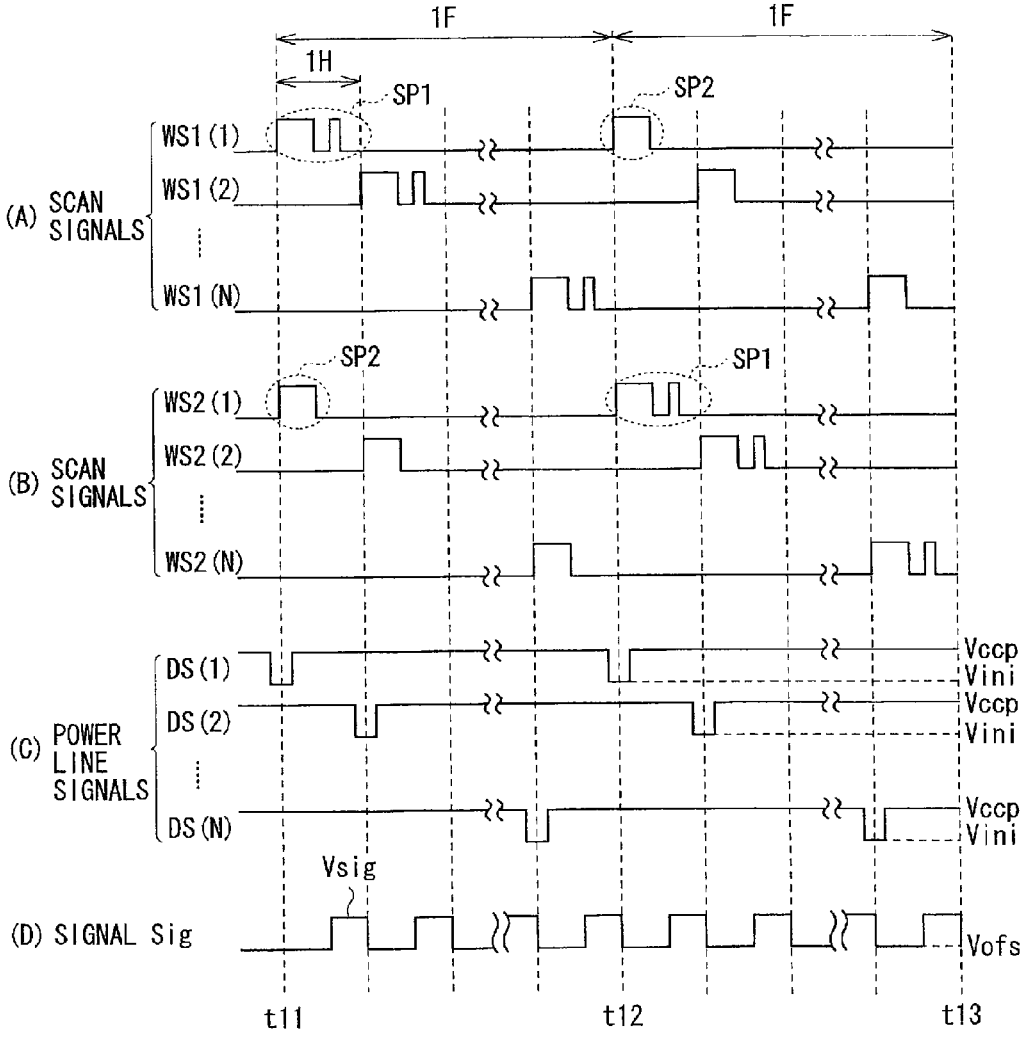
FIG. 4 is a timing waveform chart illustrating exemplary operation of the display unit illustrated in FIG. 1.

FIG. 4 illustrates exemplary operation of the display unit 1, where (A) illustrates waveforms of the scan signals WS1, (B) illustrates waveforms of the scan signals WS2, (C) illustrates waveforms of the power line signals DS, and (D) illustrates a waveform of the signal Sig. In this exemplary case, assuming that the display section 10 includes the pixels 11 for N-number of lines, (A) to (D) of FIG. 4 illustrate the waveforms for the respective N-number of lines. It is to be noted that (A) to (D) of FIG. 4 show no vertical blanking period for the convenience of description.

The display unit 1 performs display operation based on an odd-numbered frame image F(2n−1) in a period from timing t11 to timing t12 (one frame period (1F)), and performs display operation based on an even-numbered frame image F(2n) following the frame image F(2n−1) in a subsequent period from timing t12 to timing t13 (one frame period (1F)).

Specifically, in the period from timing t11 to timing t12, the scan line drive section 23 sequentially (each horizontal period (1H)) supplies a pulse SP1 to each scan line WSL1 ((A) of FIG. 4), and then sequentially (each horizontal period (1H)) supplies a pulse SP2 to each scan line WSL2 ((B) of FIG. 4). The power line drive section 24 sequentially supplies the power line signal DS that is in synchronization with each of the pulses SP1 and SP2 of the scan signals WS1 and WS2 to each power line PL ((C) of FIG. 4). The data line drive section 25 supplies the pixel voltage Vsig based on the frame image F(2n−1) to each data line DTL in synchronization with the pulse SP1 of the scan signal WS1 ((D) of FIG. 4).

Then, in the period from timing t12 to timing t13, the scan line drive section 23 sequentially (each horizontal period (1H)) supplies the pulse SP2 to each scan line WSL1 ((A) of FIG. 4), and then sequentially (each horizontal period (1H)) supplies the pulse SP1 to each scan line WSL2 ((B) of FIG. 4). The power line drive section 24 sequentially supplies the power line signal DS that is in synchronization with each of the pulses SP1 and SP2 of the scan signals WS1 and WS2 to each power line PL ((C) of FIG. 4). The data line drive section 25 supplies the pixel voltage Vsig based on the frame image F(2n) to each data line DTL in synchronization with the pulse SP1 of the scan signal WS2 ((D) of FIG. 4).

The pixel 11, to which the pulse SP1 is supplied, is subjected to correction (Vth correction and mobility (μ) correction) to suppress an influence of element variations in the drive transistor DRTr on image quality, and is subjected to writing of the pixel voltage Vsig. On the other hand, the pixel 11, to which the pulse SP2 is supplied, is subjected to only the Vth correction, and is not subjected to the writing of the pixel voltage Vsig.

Specifically, the pixels 11 connected to the scan line WSL1 perform display based on the frame image F(2n−1) in the period from timing t11 to timing t12, while the pixels 11 connected to the scan line WSL2 perform display based on the frame image F(2n) in the period from timing t12 to timing t13.

Thereafter, the display unit 1 repeats the operation in the periods from the timing t11 to the timing t13.

Figure 5:
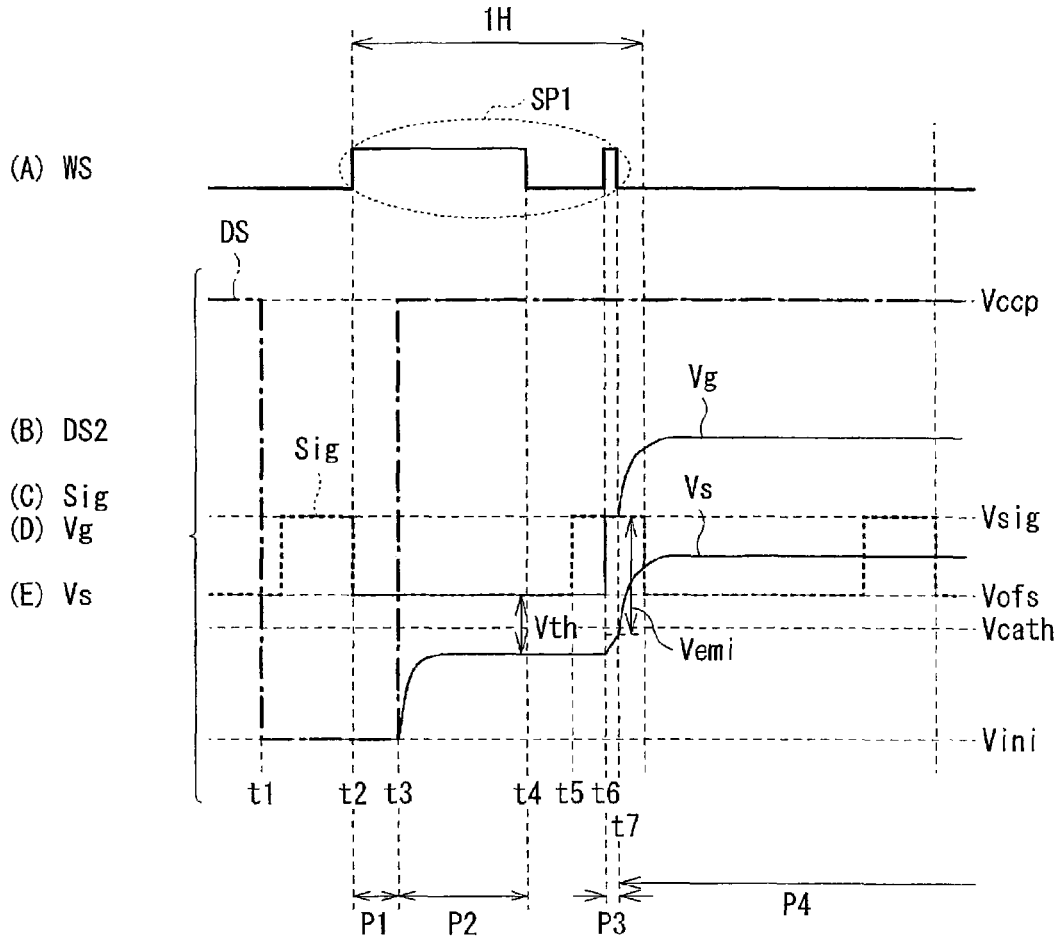
FIG. 5 is a timing waveform chart illustrating exemplary operation of the pixel illustrated in FIG. 1.

FIG. 5 illustrates a timing chart of operation of the pixel 11 to which the pulse SP1 is supplied, where (A) illustrates a waveform of the scan signal WS, (B) illustrates a waveform of the power line signal DS, (C) illustrates a waveform of the signal Sig, (D) illustrates a waveform of a gate voltage Vg of the drive transistor DRTr, and (E) illustrates a waveform of a source voltage Vs of the drive transistor DRTr. In FIG. 5, (B) to (E) illustrate the waveforms with the same voltage axis. It is to be noted that the scan signal. WS ((A) of FIG. 5) corresponds to the scan signal WS1 in the case where that pixel 11 is connected to the scan line WSL1, and corresponds to the scan signal WS2 in the case where that pixel 11 is connected to the scan line WSL2.

In one horizontal period (1H), the drive section 20 initializes the pixel 11 (an initialization period P1), performs the Vth correction to suppress the influence of the element variations in the drive transistor DRTr on image quality (a Vth correction period P2), and writes the pixel voltage Vsig to the pixel 11 and performs mobility (μ) correction different from the above-described Vth correction on the pixel 11 (a writing-μ correction period P3). Then, the organic EL element OLED of the pixel 11 emits light with a luminance corresponding to the pixel voltage Vsig written thereto (a light-emitting period P4). This operation is described in detail below.

First, the power line drive section 24 changes the voltage of the power line signal DS from the voltage Vccp to the voltage Vini at timing t1 prior to the initialization period P1 ((B) of FIG. 5). Consequently, the drive transistor DRTr is turned on, so that the source voltage Vs of the drive transistor DRTr is set to the voltage Vini ((E) of FIG. 5).

Then, the drive section 20 initializes the pixel 11 in a period from timing t2 to timing t3 (the initialization period P1). Specifically, at the timing t2, the data line drive section 25 sets the signal Sig to a voltage Vofs ((C) of FIG. 5), and the scan line drive section 23 changes the voltage of the scan signal WS from a low level to a high level ((A) of FIG. 5). Consequently, the write transistor WSTr is turned on, so that the gate voltage Vg of the drive transistor DRTr is set to the voltage Vofs ((D) of FIG. 5). In this way, a gate-to-source voltage Vgs of the drive transistor DRTr is set to a voltage, i.e., Vofs-Vini, that is larger than a threshold voltage Vth of the drive transistor DRTr, and thus the pixel 11 is initialized.

Then, the drive section 20 performs the Vth correction in a period from the timing t3 to timing t4 (the Vth correction period P2). Specifically, the power line drive section 24 changes the voltage of the power line signal DS from the voltage Vini to the voltage Vccp at the timing t3 ((B) of FIG. 5). As a result, the drive transistor DRTr operates in a saturated region, so that a current Ids flows from the drain to the source of the drive transistor DRTr, resulting in an increase in the source voltage Vs ((E) of FIG. 5). During this operation, the source voltage Vs is lower than the cathode voltage Vcath of the organic EL element OLED. Hence, the organic EL element OLED is maintained to a reverse bias state, so that no current flows through the organic EL element OLED. Such increased source voltage Vs causes a decrease in the gate-to-source voltage Vgs, resulting in a decrease in the current Ids. Such negative feedback operation causes the current Ids to converge toward zero. In other words, the gate-to-source voltage Vgs of the drive transistor DRTr converges to be equal to the threshold voltage Vth of the drive transistor DRTr (Vgs=Vth).

Then, at the timing t4, the scan line drive section 23 changes the voltage of the scan signal WS from the high level to the low level ((A) of FIG. 5). Consequently, the write transistor WSTr is turned off. The data line drive section 25 sets the signal Sig to the pixel voltage Vsig at timing t5 ((C) of FIG. 5).

Then, the drive section 20 performs the writing of the pixel voltage Vsig on the pixel 11 and the μ correction for the pixel 11 in a period from timing t6 to timing t7 (the writing-μ correction period P3). Specifically, at the timing t6, the scan line drive section 23 changes the voltage of the scan signal WS from the low level to the high level ((A) of FIG. 5). As a result, the write transistor WSTr is turned on, so that the gate voltage Vg of the drive transistor DRTr rises from the voltage Vofs to the pixel voltage Vsig ((D) of FIG. 5). During this operation, the gate-to-source voltage Vgs of the drive transistor DRTr is larger than the threshold voltage Vth (Vgs>Vth), and thus the current Ids flows from the drain to the source of the drive transistor DRTr, resulting in an increase in the source voltage Vs of the drive transistor DRTr ((E) of FIG. 5). Such negative feedback operation suppresses the influence of the element variations in the drive transistor DRTr on image quality (μ correction), and the gate-to-source voltage Vgs of the drive transistor DRTr is set to a voltage Vemi corresponding to the pixel voltage Vsig.

Then, the drive section 20 causes the pixel 11 to emit light in periods on and after the timing t7 (the light-emitting period P4). Specifically, the scan line drive section 23 changes the voltage of the scan signal WS from the high level to the low level at the timing t7 ((A) of FIG. 5). As a result, the write transistor WSTr is turned off, so that the gate of the drive transistor DRTr maintains a floating state, following which an inter-terminal voltage of the capacitor Cs, i.e., the gate-to-source voltage Vgs (=Vemi) of the drive transistor DRTr, is thus maintained. Then, as the current Ids flows through the drive transistor DRTr, the source voltage Vs of the drive transistor DRTr increases ((E) of FIG. 5), and the gate voltage Vg of the drive transistor DRTr increases accordingly ((D) of FIG. 5). When the source voltage Vs of the drive transistor DRTr exceeds the sum (Vel+Vcath) of a threshold voltage Vel of the organic EL element OLED and the voltage Vcath, a current flows between the anode and the cathode of the organic EL element OLED, causing the organic EL element OLED to emit light. In other words, the source voltage Vs increases by an amount of voltage corresponding to the element variations in the organic EL element OLED, leading to the light emission of the organic EL element OLED.

The drive performed during the initialization period P1 and the Vth correction period P2 corresponds to a specific but not limitative example of "reset drive" in one embodiment of the disclosure. The voltage Vofs corresponds to a specific but not limitative example of "first voltage" in one embodiment of the disclosure. The voltage Vini corresponds to a specific but not limitative example of "second voltage" in one embodiment of the disclosure. The voltage Vccp corresponds to a specific but not limitative example of "fourth voltage" in one embodiment of the disclosure.

Figure 6:
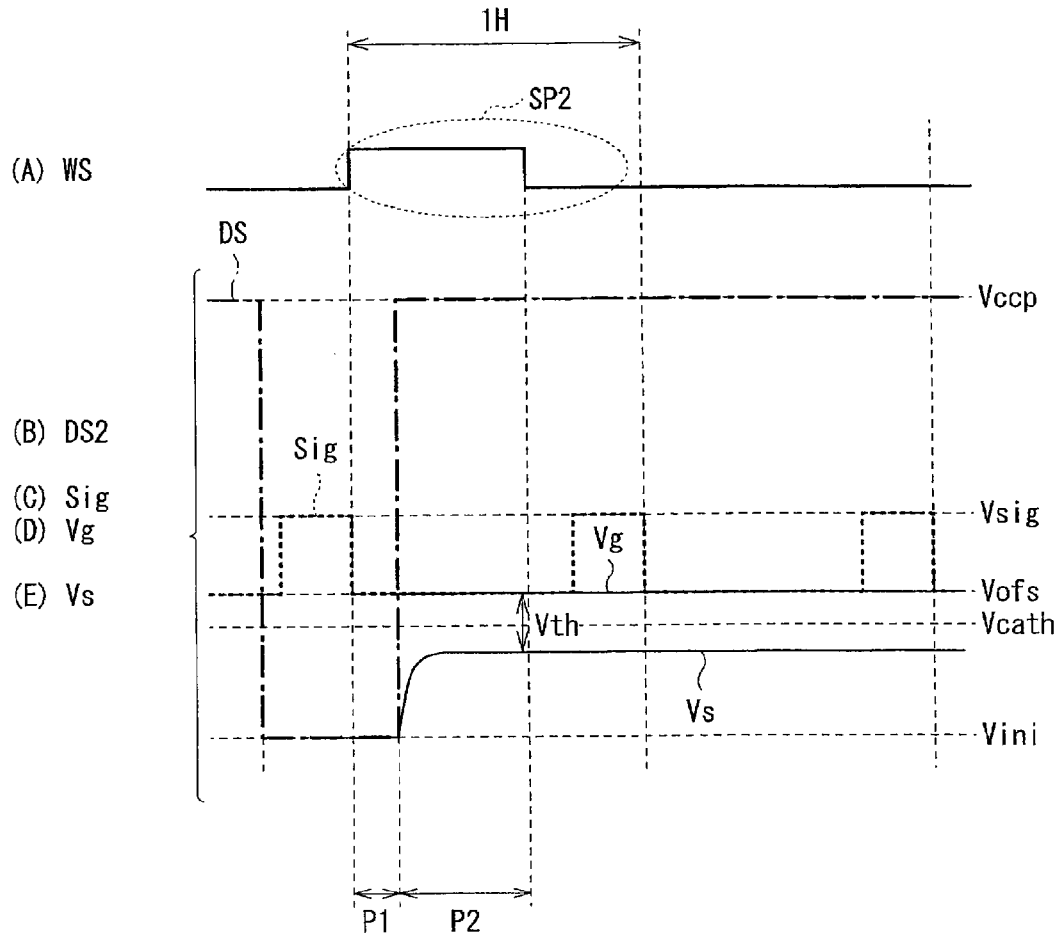
FIG. 6 is a timing waveform chart illustrating another exemplary operation of the pixel illustrated in FIG. 1.

FIG. 6 illustrates a timing chart of operation of the pixel 11 to which the pulse SP2 is supplied, where (A) illustrates a waveform of the scan signal WS, (B) illustrates a waveform of the power line signal DS, (C) illustrates a waveform of the signal Sig, (D) illustrates a waveform of the gate voltage Vg of the drive transistor DRTr, and (E) illustrates a waveform of the source voltage Vs of the drive transistor DRTr.

Within one horizontal period (1H), the drive section 20 initializes the pixel 11 to which the pulse SP2 is supplied (the initialization period P1), and performs on the pixel 11 the Vth correction to suppress the influence of the element variations in the drive transistor DRTr on image quality (the Vth correction period P2). In other words, in the initialization period P1 and the Vth correction period P2, the drive section 20 performs driving of the pixel 11 to which the pulse SP2 is supplied in a manner similar to the driving of the pixel 11 to which the pulse SP1 is supplied, but does not perform the subsequent operation such as writing of the pixel voltage Vsig. Consequently, in the pixel 11 to which the pulse SP2 is supplied, the gate-to-source voltage Vgs of the drive transistor DRTr is set to a voltage approximately equal to the threshold voltage Vth of the drive transistor DRTr (Vgs=Vth), and thus no current flows through the organic EL element OLED. Specifically, the pixel 11 to which the pulse SP2 is supplied performs black display.

In this way, in the display unit 1, the pixel 11 to which the pulse SP1 is supplied performs display corresponding to the pixel voltage Vsig, and the pixel 11 to which the pulse SP2 is supplied performs black display.

In the display section 10, as illustrated in FIG. 3, one of the two pixels 11 adjacent to each other in the row direction (horizontal direction) is connected to the scan line WSL1, while the other is connected to the scan line WSL2. As a result, one of the two pixels 11 adjacent to each other in the row direction, which are connected to certain one of the data lines DTL, may perform the operation illustrated in FIG. 5, and the other may perform the operation illustrated in FIG. 6. In other words, the drive section 20 writes the pixel voltage Vsig to only one of the two pixels 11 within one frame period. This further ensures time for performing the writing of the pixel voltage Vsig, thereby making it possible to reduce a possibility of a reduction in image quality. Specifically, for example, in the case where the pixel voltage Vsig is time-divisionally written to both of the two pixels 11 within one frame period, time necessary for performing the writing is reduced, which in turn results in insufficient writing of the pixel voltage Vsig, leading to a possibility of a reduction in image quality. In particular, in the case where a high-definition display panel is used for the display section 10, a large number of lines are necessary to be driven within one frame period (for example, 16.6 msec=1/60 Hz). This reduces time allocated for one horizontal period (1H), which in turn results in insufficient writing of the pixel voltage Vsig, leading to a possibility of a reduction in image quality. In contrast, in the display unit 1 according to the present embodiment, the pixel voltage Vsig is written to only one of such two pixels 11 within one frame period, thereby making it possible to reduce a possibility of a reduction in image quality.

Figure 7A:
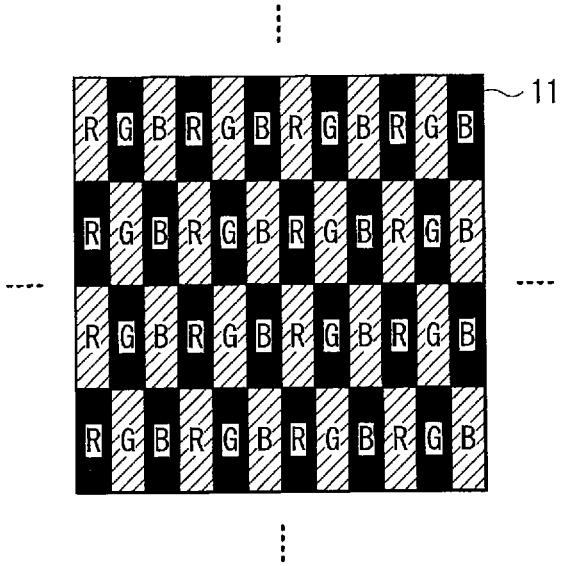
FIG. 7A is an explanatory diagram illustrating exemplary operation of the pixel illustrated in FIG. 1.
Figure 7B:
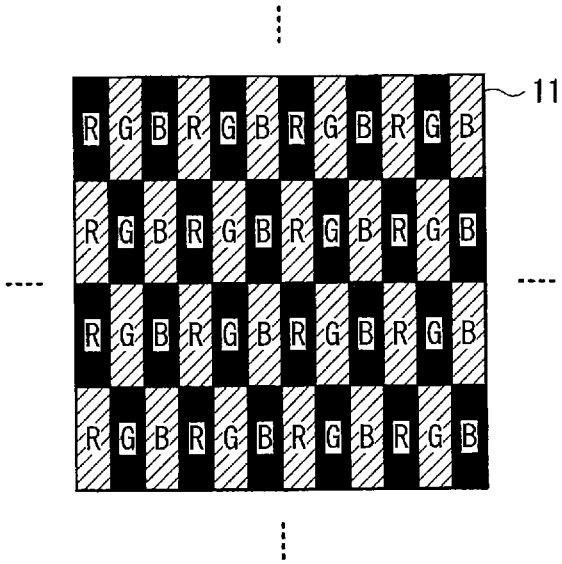
FIG. 7B is an explanatory diagram illustrating another exemplary operation of the pixel illustrated in FIG. 1.

FIG. 7A illustrates operation of each pixel 11 during display of the frame image F(2n−1), and FIG. 7B illustrates operation of each pixel 11 during display of the frame image F(2n). In FIGS. 7A and 7B, each of shaded pixels 11 indicates the pixel 11 that performs display corresponding to the pixel voltage Vsig. On the other hand, each pixel 11 depicted with black indicates the pixel 11 that performs black display. As illustrated in FIGS. 7A and 7B, in the display unit 1, the pixels 11 perform the display corresponding to the pixel voltage Vsig in a checkerboard-like pattern while the remaining pixels 11 perform the black display in each frame period. In addition, a display mode of each pixel 11 is switched between the display corresponding to the pixel voltage Vsig and the black display for each frame period. As a result, a viewer sees an image displayed by all pixels 11 of the display section 10 through viewing images displayed over two frame periods.

In this way, the display unit 1 performs the display corresponding to the pixel voltage Vsig in a checkerboard-like pattern in each frame period. This makes it possible to reduce a possibility of a reduction in image quality as described in contrast with a comparative example below.

Moreover, in the display unit 1, each pixel 11, to which no pixel voltage Vsig is written, performs the black display, thereby making it possible to improve image quality during display of moving images. Specifically, for example, if the pixel 11, to which no pixel voltage Vsig is written, continues the display as it is based on the pixel voltage Vsig for a previous frame image F, a current frame image F and the previous frame image F are mixedly displayed, leading to a possibility of a reduction in image quality. In contrast, in the display unit 1, each pixel 11, to which no pixel voltage Vsig is written, performs the black display. This prevents the plurality of frame images F from being mixedly displayed, thereby making it possible to reduce a possibility of a reduction in image quality.

Furthermore, in the display unit 1, each pixel 11 to which no pixel voltage Vsig is written, is subjected to the Vth correction drive to perform the black display, thereby making it possible to reduce a possibility of a reduction in image quality. Specifically, for example, if the pixel voltage Vsig indicating black is written to each pixel 11 to which no pixel voltage Vsig is written, the pixel voltage Vsig is necessary to be time-divisionally written to both of the two pixels 11 adjacent to each other in the row direction in one horizontal period as described above, which results in insufficient writing of the pixel voltage Vsig, leading to a possibility of a reduction in image quality. In contrast, in the display unit 1, each pixel 11 to which no pixel voltage Vsig is written is subjected to the Vth correction drive to perform the black display, which allows the two pixels 11 to be subjected to the Vth correction drive together, thereby making it possible to reduce a possibility of a reduction in image quality.

Comparative Example

A display unit 1R according to a comparative example is now described. This comparative example has a configuration similar to that in the present embodiment (FIG. 1) except for connection of each pixel 11 to the scan line WSL1 or WSL2.

Figure 8:
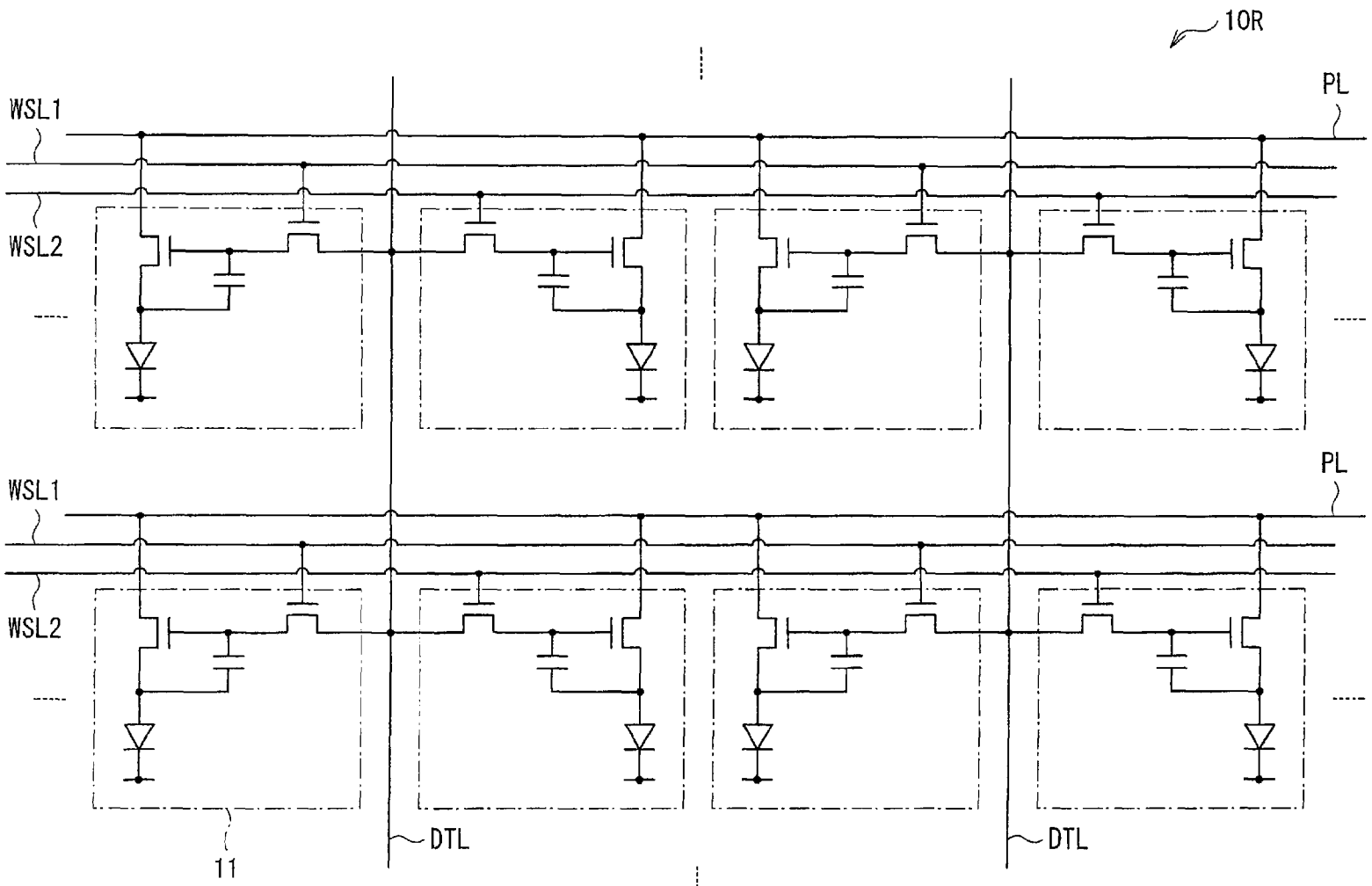
FIG. 8 is a circuit diagram illustrating exemplary connection between pixels according to a comparative example.

FIG. 8 illustrates an exemplary configuration of a display section 10R of the display unit 1R according to the comparative example. In the display section 10R, two pixels 11 adjacent to each other in the column direction (vertical direction) are both connected to the scan line WSL1 or WSL2. Specifically, although one of the two pixels 11 adjacent to each other in the column direction is connected to the scan line WSL1 while the other is connected to the scan line WSL2 in the display section 10 according to the present embodiment as illustrated in FIG. 3, the two pixels 11 are both connected to the scan line WSL1 or WSL2 in the display section 10R according to the comparative example.

Figure 9A:
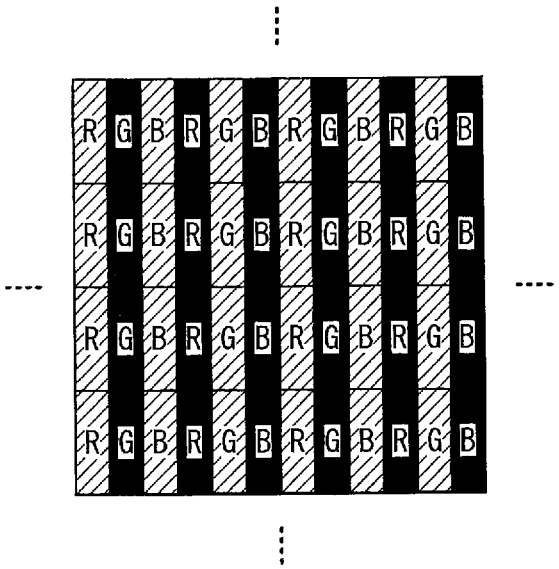
FIG. 9A is an explanatory diagram illustrating exemplary operation of a pixel illustrated in FIG. 8.
Figure 9B:
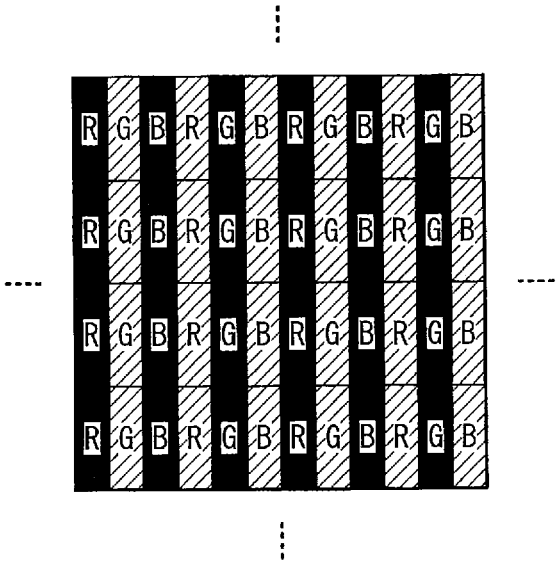
FIG. 9B is an explanatory diagram illustrating another exemplary operation of the pixel illustrated in FIG. 8.

FIGS. 9A and 9B illustrate operation of each pixel 11 of the display section 10R according to the comparative example, where FIG. 9A illustrates operation during display of a frame image F(2n−1), and FIG. 9B illustrates operation during display of a frame image F(2n). In this exemplary case, the pixels 11 in alternate columns perform the display corresponding to the pixel voltage Vsig, while the remaining pixels 11 perform the black display. In such a case, a viewer feels as if an image is displayed in a stripe pattern, leading to a possibility of a reduction in image quality.

In contrast, in the display unit 1 according to the present embodiment, as illustrated in FIG. 3, one of any two pixels 11 adjacent to each other in the column direction (vertical direction) is connected to the scan line WSL1, while the other is connected to the scan line WSL2. As illustrated in FIGS. 7A and 7B, this enables the display corresponding to the pixel voltage Vsig to be performed in a checkerboard-like pattern, thereby making it possible to reduce a possibility of a reduction in image quality.

Effects

As described above, in the present embodiment, any two pixels that are adjacent to each other in the row direction are connected to one data line, thereby making it possible to reduce a bezel region.

Also, in the present embodiment, the pixel voltage may be written to only one of the pixels adjacent to each other in the row direction (horizontal direction) in each frame period, which ensures time for performing the writing of the pixel voltage, thereby making it possible to reduce a possibility of a reduction in image quality.

Furthermore, in the present embodiment, the display section may perform the display corresponding to the pixel voltage in a checkerboard-like pattern, which makes it possible to reduce a possibility of a reduction in image quality.

Moreover, in the present embodiment, each pixel, to which no pixel voltage is written, may performs the black display, which a plurality of frame images from being mixedly displayed, thereby making it possible to improve image quality during display of moving images.

Furthermore, in the present embodiment, each pixel, to which no pixel voltage is written, may be subjected to the Vth correction drive to perform the black display. Hence, a necessity of writing a pixel voltage indicating black may be eliminated, which makes it possible to reduce a possibility of a reduction in image quality.

Modification 1-1

Although each pixel 11, to which no pixel voltage is written, performs the black display in the embodiment described above, the disclosure is not limited thereto. Alternatively, for example, such pixel 11 may continue the display as it is based on the pixel voltage Vsig for a previous frame image F. This modification (Modification 1-1) is now described in detail.

Figure 10:
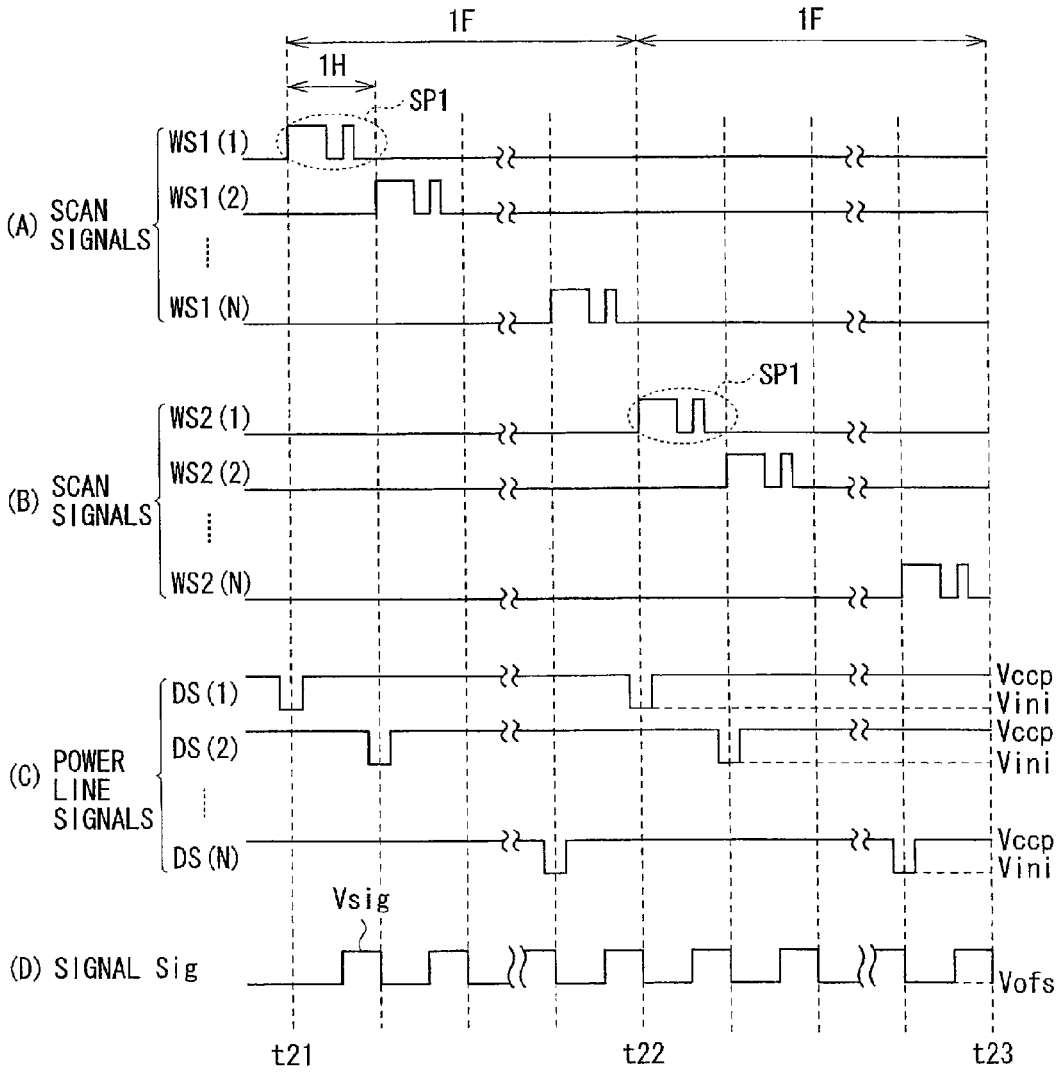
FIG. 10 is a timing waveform chart illustrating exemplary operation of a display unit according to a Modification of the example embodiment.

FIG. 10 illustrates exemplary operation of a display unit 1A according to the Modification 1-1, where (A) illustrates waveforms of N-number of scan signals WS1, (B) illustrates waveforms of N-number of scan signals WS2, (C) illustrates waveforms of N-number of power line signals DS, and (D) illustrates a waveform of a signal Sig.

First, in a period from timing t21 to timing t22, a scan line drive section 23A of the display unit 1A sequentially supplies a pulse SP1 to each scan line WSL1 for each horizontal period (1H) ((A) of FIG. 10). During this operation, the scan line drive section 23A does not supply a pulse SP2 to each scan line WSL2 unlike the embodiment ((B) of FIG. 4) described above. In a period from timing t22 to timing t23, the scan line drive section 23A sequentially supplies the pulse SP1 to each scan line WSL2 for each horizontal period (1H) ((B) of FIG. 10). During this operation, the scan line drive section 23A does not supply the pulse SP2 to each scan line WSL1 unlike the embodiment ((A) of FIG. 4) described above.

Figure 11A:
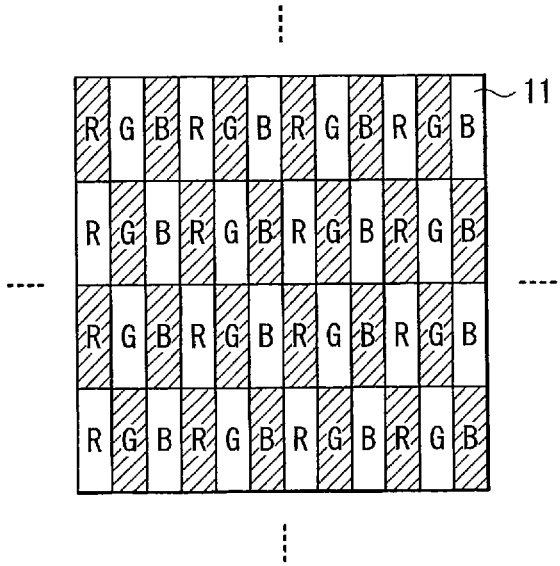
FIG. 11A is an explanatory diagram illustrating exemplary operation of a pixel illustrated in FIG. 10.
Figure 11B:
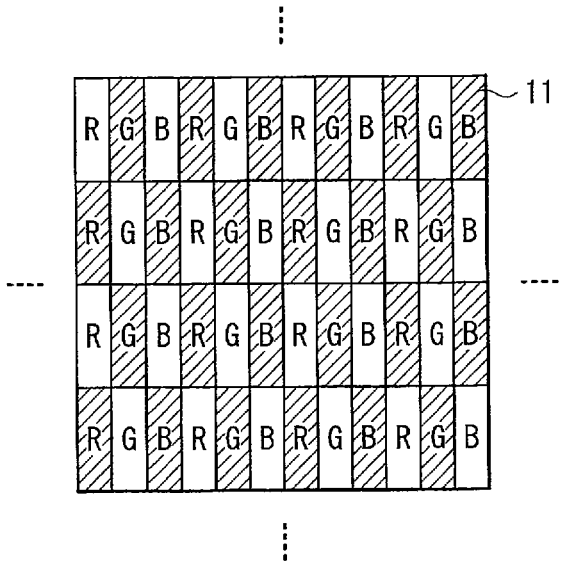
FIG. 11B is an explanatory diagram illustrating another exemplary operation of the pixel illustrated in FIG. 10.

FIG. 11A illustrates operation of each pixel 11 during display of a frame image F(2n−1), and FIG. 11B illustrates operation of each pixel 11 during display of a frame image F(2n). In FIGS. 11A and 11B, each shaded pixel 11 indicates the pixel 11 that performs the display corresponding to the pixel voltage Vsig. On the other hand, each unshaded pixel 11 is not driven in that frame period and indicates the pixel that displays the previous frame image F.

Such a configuration may be used for applications where an influence on image quality is comparatively little. Examples of such applications may include an application where a still image is displayed, an application where a slow moving image is displayed, and the like.

Modification 1-2

Although the drive section 20 constantly performs the drive illustrated in (A) to (D) of FIG. 4 in the embodiment described above, the disclosure is not limited thereto. Alternatively, for example, the drive section 20 may have a plurality of drive modes containing a drive mode that performs the drive illustrated in (A) to (D) of FIG. 4. Also, the drive section 20 may have a drive mode that performs the drive described in the Modification 1-1 ((A) to (D) of FIG. 10).

2. Application Examples

Application examples of each of the displays described in the above-described embodiment and the Modifications are now described.

Figure 12:
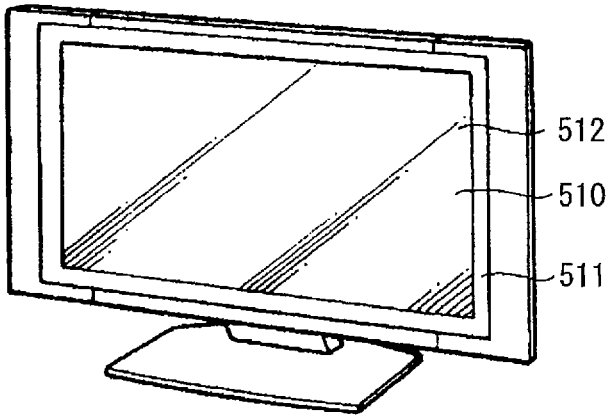
FIG. 12 is a perspective view illustrating an appearance configuration of a television unit to which the display unit according to any of the example embodiment and the Modifications is applied.

FIG. 12 illustrates appearance of a television unit to which any of the display units according to the above-described embodiment and the Modifications is applied. The television unit may have, for example, an image display screen section 510 including a front panel 511 and filter glass 512. The television unit is configured of the display unit according to any of the above-described embodiment and the Modifications.

The display unit according to any of the above-described embodiment and the Modifications is applicable to an electronic apparatus in any field. In addition to the television unit, examples of the electronic apparatus may include a digital camera, a notebook personal computer, a mobile terminal unit such as a mobile phone, a portable video game player, and a video camera. In other words, the display unit according to any of the above-described embodiment and the Modifications is applicable to an electronic apparatus that displays images in any field.

Although the present technology has been described with reference to the example embodiments, the Modifications, and the application examples hereinbefore, the technology is not limited thereto, and various modifications or alterations thereof may be made.

For example, although the display unit includes the organic EL display elements in the example embodiments described above, the display unit is not limited thereto, and may be any display unit including current-drive display elements.

Furthermore, the technology encompasses any possible combination of some or all of the various embodiments described herein and incorporated herein.

It is possible to achieve at least the following configurations from the above-described example embodiments of the disclosure.

(1) A display unit comprising:

a plurality of pixel circuits disposed in a matrix form comprising rows and columns; and a drive control section configured to cause the plurality of pixel circuits to display image frames corresponding to input image data such that a given frame of the image frames is displayed as a first sub-frame and as a second sub-frame, wherein the first sub-frame is displayed by a portion of the plurality of pixel circuits comprising a checked pattern including every other pixel circuit in each row and every other pixel circuit in each column, such that each pixel circuit displaying the first sub-frame begins display thereof during a first half of a given frame period, and the second sub-frame is displayed by those of the plurality of pixel circuits that do not display the first sub-frame, such that each pixel circuit displaying the second sub-frame begins display thereof during a second half of the given frame period.

(2) The display unit of (1), further comprising:

a plurality of write scanning lines; and a plurality of signal lines, wherein each of the plurality of pixel circuits includes:

a display element, a first transistor configured to sample a potential carried on one of the plurality of signal lines when a scanning pulse is applied to one of the plurality of write scanning lines, which is connected to the first transistor, a capacitor with a first terminal configured to hold the potential sampled by the first transistor, and a second transistor configured to supply a drive current to the display element, the magnitude of the drive current corresponding to a voltage between the first terminal of the capacitor and a second terminal of the capacitor.

(3) The display unit of (1) or (2), wherein the plurality of pixel circuits are grouped into pairs of pixel circuits such that each of the pairs of pixel circuits includes two pixel circuits that are adjacent to each other in a same row and that are connected to a same one of the plurality of signal lines, and for each of the pairs of pixel circuits, one pixel circuit of the respective pair of pixel circuits displays the first sub-frame and the other pixel circuit of the respective pair of pixel circuits displays the second sub-frame.

(4) The display unit any one of (1) to (3), wherein the plurality of write scanning lines are grouped into a first group and a second group, wherein, for each of the pairs of pixel circuits, the one of the pixel circuits included in the respective pair of pixel circuits that displays the first sub-frame is connected to a write scanning line of the first group, and the other one of the pixel circuits included in the respective pair of pixel circuits, which displays the second sub-frame, is connected to a write scanning line of the second group.

(5) The display unit any one of (1) to (4), wherein, for each row of the plurality of pixel circuits, pixel circuits located at even-numbered column positions of the row are each connected to a same one of the plurality of write scanning lines as each other and pixel circuits located at odd-numbered column positions of the row are each connected to a same one of the plurality of write scanning lines as each other that is different from the one of the plurality of write scanning lines to which the pixel circuits located at the even-numbered column positions of the row are connected.

(6) The display unit any one of (1) to (5), wherein, for a given column of the plurality of pixel circuits, pixel circuits located at even-numbered row positions of the given column are connected to write scanning lines of the first group and pixel circuits located at odd-numbered row positions of the column are connected to write scanning lines of the second group.

(7) The display unit any one of (1) to (6), wherein the plurality of pixel circuits are configured to perform, under control of the drive control section, a threshold correction operation that results in storing a threshold voltage of the second transistor of the respective one of the plurality of pixel circuit in the capacitor of the respective one of the plurality of pixel circuit.

(8) The display unit any one of (1) to (7), wherein the drive control section is configured to cause a given pixel circuit of the plurality of pixel circuits to perform the threshold correction operation by causing the first transistor of the given pixel circuit to be in a conductive state while a reference potential is carried on the signal line connected to the given pixel circuit and while a drive voltage is applied to the second transistor of the given pixel circuit.

(9) The display unit any one of (1) to (8), wherein the threshold correction operation is performed simultaneously for all of those of the plurality of pixel circuits disposed in a same row.

(10) A display unit comprising:

a plurality of write scanning lines;

a plurality of signal lines; and a plurality of pixel circuits disposed in a matrix form comprising rows and columns, wherein the plurality of pixel circuits are grouped into pairs of pixel circuits such that each of the pairs of pixel circuits includes two pixel circuits that are adjacent to each other in a same row and that are connected to a same one of the plurality of signal lines, and wherein, for each of the pairs of pixel circuits, one of the pixel circuits included in the pair of pixel circuits is connected to one of the plurality of write scanning lines and the other one of the pixel circuits included in the pair of pixel circuits is connected to a different one of the plurality of write scanning lines.

(11) The display unit of (10), wherein each of the plurality of pixel circuits includes:

a display element, a first transistor configured to sample a potential carried on one of the plurality of signal lines when a scanning pulse is applied to one of the plurality of write scanning lines, which is connected to the first transistor, a capacitor with a first terminal configured to hold the potential sampled by the first transistor, and a second transistor configured to supply a drive current to the display element, the magnitude of the drive current corresponding to a voltage between the first terminal of the capacitor and a second terminal of the capacitor.

(12) The display unit of (10) or (11), further comprising a drive control section configured to cause the plurality of pixel circuits to display image frames corresponding to input image data such that a given frame of the image frames is displayed as a first sub-frame and as a second sub-frame, wherein the plurality of write scanning lines are grouped into a first group and a second group, such that, for each of the pairs of pixel circuits, one of the pixel circuits included in the respective pair of pixel circuits is connected to a write scanning line of the first group and the other one of the pixel circuits included in the respective pair of pixel circuits is connected to a write scanning line of the second group, the first sub-frame is displayed by those of the plurality of pixel circuits connected to scanning lines of the first group, such that each pixel circuit displaying the first sub-frame begins display thereof during a first half of a given frame period, and the second sub-frame is displayed by those of the plurality of pixel circuits connected to scanning lines of the second group, such that each pixel circuit displaying the second sub-frame begins display thereof during a second half of the given frame period.

(13) The display unit any one of (10) to (12), wherein, for each row of the plurality of pixel circuits, pixel circuits located at even-numbered column positions of the row are each connected to a same one of the plurality of write scanning lines as each other and pixel circuits located at odd-numbered column positions of the row are each connected to a same one of the plurality of write scanning lines as each other that is different from the one of the plurality of write scanning lines to which the pixel circuits located at the even-numbered column positions of the row are connected.

(14) The display unit any one of (10) to (13), wherein, for a given column of the plurality of pixel circuits, pixel circuits located at even-numbered row positions of the given column are connected to write scanning lines of the first group and pixel circuits located at odd-numbered row positions of the column are connected to write scanning lines of the second group.

(15) The display unit any one of (10) to (14), wherein the plurality of pixel circuits are configured to perform, under control of the drive control section, a threshold correction operation that results in storing a threshold voltage of the second transistor of the respective one of the plurality of pixel circuit in the capacitor of the respective one of the plurality of pixel circuit.

(16) The display unit any one of (10) to (15), wherein the drive control section is configured to cause a given pixel circuit of the plurality of pixel circuits to perform the threshold correction operation by causing the first transistor of the given pixel circuit to be in a conductive state while a reference potential is carried on the signal line connected to the given pixel circuit and while a drive voltage is applied to the second transistor of the given pixel circuit.

(17) The display unit any one of (10) to (16), wherein the threshold correction operation is performed simultaneously for all of those of the plurality of pixel circuits disposed in a same row.

(18) The display unit any one of (10) to (17), wherein the drive control section is configured to cause the plurality of pixel circuits to display image frames corresponding to input image data such that such that a given frame of the image frames is displayed during a given frame period as a first sub-frame and as a second sub-frame, during a first half of the given frame period, in which video signal potentials corresponding to the first sub-frame are carried on the signal lines, for each of the pairs of pixel circuits, only one of the pixel circuits included in the respective pair of pixel circuits samples a video signal potential corresponding to a display gradation, and during a second half of the given frame period, in which video signal potentials corresponding to the second sub-frame are carried on the signal lines, for each of the pairs of pixel circuits, the one of the pixel circuits included in the respective pair of pixel circuits that did not sample a video signal potential corresponding to a display gradation during the first half of the given frame period samples a video signal potential corresponding to a display gradation.

(19) The display unit any one of (10) to (18), wherein the plurality of write scanning lines are grouped into a first group and a second group, such that, for each of the pairs of pixel circuits, one of the pixel circuits included in the respective pair of pixel circuits is connected to a write scanning line of the first group and the other one of the pixel circuits included in the respective pair of pixel circuits is connected to a write scanning line of the second group, those of the plurality of pixel circuits connected to scanning lines of the first group sample video signal potential corresponding to display gradations during the first half of the given frame period, and those of the plurality of pixel circuits connected to scanning lines of the second group sample video signal potential corresponding to display gradations during the second half of the given frame period.

(20) The display unit any one of (10) to (19), further comprising a drive control section configured to cause the plurality of pixel circuits to display image frames corresponding to input image data such that a given frame of the image frames is displayed as a first sub-frame and as a second sub-frame, wherein only a first portion of the plurality of pixel circuits comprising a checked pattern are caused to display during a first part of a given frame period, and those of the plurality of pixel circuits that do not display during the first half of the given frame period are caused to display during a second part of the given frame period

(21) A display unit, including:

a plurality of pixels;

a plurality of first-group scan lines extending in a first direction; and a plurality of second-group scan lines extending in the first direction, wherein one of any two pixels that are adjacent to each other in a second direction that intersects with the first direction of the plurality of pixels is connected to one of the first-group scan lines, and the other of the any two pixels is connected to one of the second-group scan lines.

(22) The display unit according to (21), further including a plurality of pixel signal lines extending in the second direction, wherein any two pixels that are adjacent to each other in the first direction of the plurality of pixels are each connected to common one of the pixel signal lines, and one of the any two pixels that are adjacent to each other in the first direction is connected to one of the first-group scan lines, and the other of the any two pixels is connected to one of the second-group scan lines.

(23) The display unit according to (21) or (22), further including a drive section that drives the plurality of pixels based on a first frame image and a second frame image that are supplied alternately, wherein the drive section is configured to perform:

a first drive that sequentially performs, based on the first frame image, write drives on a plurality of first pixels of the plurality of pixels, the first pixels being connected to the plurality of first-group scan lines; and a second drive that sequentially performs, based on the second frame image, the write drives on a plurality of second pixels of the plurality of pixels, the second pixels being connected to the plurality of second-group scan lines.

(24) The display unit according to (23), wherein the drive section is configured to perform:

reset drive, prior to each of the write drives, on one of the first pixels subjected to the write drive, in the first drive; and the reset drive, prior to each of the write drives, on one of the second pixels subjected to the write drive, in the second drive.

(25) The display unit according to (24), wherein the drive section is configured to perform:

the reset drives on the second pixels, in the first drive; and the reset drives on the first pixels, in the second drive.

(26) The display unit according to (25), wherein the drive section is configured to perform the reset drives on the any two pixels that are adjacent to each other in the first direction together.

(27) The display unit according to any one of (24) to (26), wherein each of the plurality of pixels includes:

a display element;

a first transistor including a gate and a source that is connected to the display element;

a capacitor inserted between the gate and the source of the first transistor; and a second transistor including a gate connected to one of the first-group scan lines or one of the second-group scan lines, and turned on to set a gate voltage of the first transistor.

(28) The display unit according to (27), wherein the drive section is, in each of the reset drives, configured to set the gate voltage of the first transistor to a first voltage and set a source voltage of the first transistor to a second voltage, and then cause a current to flow through the first transistor to set the source voltage of the first transistor to a third voltage that corresponds to a threshold voltage of the first transistor.

(29) The display unit according to (28), wherein the first transistor includes a drain connected to the drive section, and wherein the drive section is, in each of the reset drives, configured to turn on the second transistor to set the gate voltage of the first transistor to the first voltage, apply the second voltage to the drain of the first transistor to set the source voltage of the first transistor to the second voltage, and then apply a fourth voltage to the drain of the first transistor to cause the current to flow through the first transistor.

(30) A drive circuit, including a drive section driving a display section, the display section including a plurality of pixels, a plurality of first-group scan lines extending in a first direction, and a plurality of second-group scan lines extending in the first direction, one of any two pixels that are adjacent to each other in a second direction that intersects with the first direction of the plurality of pixels being connected to one of the first-group scan lines, and the other of the any two pixels being connected to one of the second-group scan lines, wherein the drive section is configured to perform a first drive that sequentially performs, based on a first frame image between the first frame image and a second frame image that are supplied alternately, write drives on a plurality of first pixels of the plurality of pixels, the first pixels being connected to the plurality of first-group scan lines, and a second drive that sequentially performs, based on the second frame image, the write drives on a plurality of second pixels of the plurality of pixels, the second pixels being connected to the plurality of second-group scan lines.

(31) A drive method, including:

preparing a display section, the display section including a plurality of pixels, a plurality of first-group scan lines extending in a first direction, and a plurality of second-group scan lines extending in the first direction, one of any two pixels that are adjacent to each other in a second direction that intersects with the first direction of the plurality of pixels being connected to one of the first-group scan lines, and the other of the any two pixels being connected to one of the second-group scan lines;

performing a first drive that sequentially performs, based on a first frame image between the first frame image and a second frame image that are supplied alternately, write drives on a plurality of first pixels of the plurality of pixels, the first pixels being connected to the plurality of first-group scan lines; and performing a second drive that sequentially performs, based on the second frame image, the write drives on a plurality of second pixels of the plurality of pixels, the second pixels being connected to the plurality of second-group scan lines.

(32) An electronic apparatus provided with a display unit and a control section that controls operation of the display unit, the display unit including:

a plurality of pixels;

a plurality of first-group scan lines extending in a first direction; and a plurality of second-group scan lines extending in the first direction, wherein one of any two pixels that are adjacent to each other in a second direction that intersects with the first direction of the plurality of pixels is connected to one of the first-group scan lines, and the other of the any two pixels is connected to one of the second-group scan lines.

The present disclosure contains subject matter related to that disclosed in Japanese Priority Patent Application JP 2012-170486 filed in the Japan Patent Office on Jul. 31, 2012, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display unit comprising:

a plurality of pixel circuits disposed in a matrix form comprising rows and columns; and drive control circuitry configured to cause the plurality of pixel circuits to display image frames of input image data such that a given frame of the image frames is displayed as a first sub-frame and as a second sub-frame, wherein the first sub-frame is displayed by a portion of the plurality of pixel circuits comprising a checked pattern including every other pixel circuit in each row and every other pixel circuit in each column, such that each pixel circuit displaying the first sub-frame begins display thereof during a first half of a given frame period, the second sub-frame is displayed by those of the plurality of pixel circuits that do not display the first sub-frame, such that each pixel circuit displaying the second sub-frame begins display thereof during a second half of the given frame period, during a first drive mode, power line drive circuitry of the drive control circuitry and scan line drive circuitry of the drive control circuitry are configured to cause each pixel circuit displaying the first sub-frame to perform a threshold correction during the first half of the given frame period but to not perform the threshold correction during the second half of the given frame period, and each pixel displaying the second sub-frame to not perform a threshold correction during the first half of the given frame period but to perform the threshold correction during the second half of the given frame period, and during a second drive mode, the power line drive circuitry and the scan line drive circuitry are configured to cause each pixel circuit displaying the first sub-frame to perform the threshold correction during both the first half and the second half of the given frame period, and each pixel circuit displaying the second sub-frame to perform the threshold correction during both the first half and the second half of the given frame period.

2. The display unit of claim 1, further comprising:

a plurality of write scanning lines; and a plurality of signal lines, wherein each of the plurality of pixel circuits includes:

a display element, a first transistor configured to sample a potential carried on one of the plurality of signal lines when a scanning pulse is applied to one of the plurality of write scanning lines, which is connected to the first transistor, a capacitor with a first terminal configured to hold the potential sampled by the first transistor, and a second transistor configured to supply a drive current to the display element, the magnitude of the drive current corresponding to a voltage between the first terminal of the capacitor and a second terminal of the capacitor.

3. The display unit of claim 2, wherein the plurality of pixel circuits are grouped into pairs of pixel circuits such that each of the pairs of pixel circuits includes two pixel circuits that are adjacent to each other in a same row and that are connected to a same one of the plurality of signal lines, and for each of the pairs of pixel circuits, one pixel circuit of the respective pair of pixel circuits displays the first sub-frame and the other pixel circuit of the respective pair of pixel circuits displays the second sub-frame.

4. The display unit of claim 3, wherein the plurality of write scanning lines are grouped into a first group and a second group, wherein, for each of the pairs of pixel circuits, the one of the pixel circuits included in the respective pair of pixel circuits that displays the first sub-frame is connected to a write scanning line of the first group, and the other one of the pixel circuits included in the respective pair of pixel circuits, which displays the second sub-frame, is connected to a write scanning line of the second group.

5. The display unit of claim 4, wherein, for each row of the plurality of pixel circuits, pixel circuits located at even-numbered column positions of the row are each connected to a same one of the plurality of write scanning lines as each other and pixel circuits located at odd-numbered column positions of the row are each connected to a same one of the plurality of write scanning lines as each other that is different from the one of the plurality of write scanning lines to which the pixel circuits located at the even-numbered column positions of the row are connected.

6. The display unit of claim 5, wherein, for a given column of the plurality of pixel circuits, pixel circuits located at even-numbered row positions of the given column are connected to write scanning lines of the first group and pixel circuits located at odd-numbered row positions of the column are connected to write scanning lines of the second group.

7. The display unit of claim 2, wherein the plurality of pixel circuits are configured to perform, under control of the drive control circuitry, a threshold correction operation that results in storing a threshold voltage of the second transistor of the respective one of the plurality of pixel circuit in the capacitor of the respective one of the plurality of pixel circuit.

8. The display unit of claim 7, wherein the drive control circuitry is configured to cause a given pixel circuit of the plurality of pixel circuits to perform the threshold correction operation by causing the first transistor of the given pixel circuit to be in a conductive state while a reference potential is carried on the signal line connected to the given pixel circuit and while a drive voltage is applied to the second transistor of the given pixel circuit.

9. The display unit of claim 8, wherein the threshold correction operation is performed simultaneously for all of those of the plurality of pixel circuits disposed in a same row.

10. A display unit comprising:

a plurality of write scanning lines;

a plurality of signal lines; and a plurality of pixel circuits disposed in a matrix form comprising rows and columns, drive control circuitry configured to cause the plurality of pixel circuits to display image frames of input image data such that a given frame of the image frames is displayed as a first sub-frame and as a second sub-frame, wherein the plurality of pixel circuits are grouped into pairs of pixel circuits such that each of the pairs of pixel circuits includes two pixel circuits that are adjacent to each other in a same row and that are connected to a same one of the plurality of signal lines, and wherein, the plurality of write scanning lines are grouped into a first group and a second group, such that, for each of the pairs of pixel circuits, one of the pixel circuits included in the respective pair of pixel circuits is connected to one of the write scanning lines of the first group and the other one of the pixel circuits included in the respective pair of pixel circuits is connected to one of the write scanning lines of the second group, the first sub-frame is displayed by those of the plurality of pixel circuits connected to scanning lines of the first group, such that each pixel circuit displaying the first sub-frame begins display thereof during a first half of a given frame period, and the second sub-frame is displayed by those of the plurality of pixel circuits connected to scanning lines of the second group, such that each pixel circuit displaying the second sub-frame begins display thereof during a second half of the given frame period, for each row of the plurality of pixel circuits, pixel circuits located at even-numbered column positions of the row are each connected to a same one of the plurality of write scanning lines as each other and pixel circuits located at odd-numbered column positions of the row are each connected to a same one of the plurality of write scanning lines as each other that is different from the one of the plurality of write scanning lines to which the pixel circuits located at the even-numbered column positions of the row are connected, for a given column of the plurality of pixel circuits, pixel circuits located at even-numbered row positions of the given column are connected to write scanning lines of the first group and pixel circuits located at odd-numbered row positions of the column are connected to write scanning lines of the second group, during a first drive mode, power line drive circuitry of the drive control circuitry and scan line drive circuitry of the drive control circuitry are configured to cause those of the plurality of pixel circuits connected to scanning lines of the first group to perform a threshold correction during the first half of the given frame period but to not perform the threshold correction during the second half of the given frame period, and those of the plurality of pixel circuits connected to scanning lines of the second group to not perform a threshold correction during the first half of the given frame period but to perform the threshold correction during the second half of the given frame period, and during a second drive mode, the power line drive circuitry and the scan line drive circuitry are configured to cause those of the plurality of pixel circuits connected to scanning lines of the first group to perform the threshold correction during both the first half and the second half of the given frame period, and those of the plurality of pixel circuits connected to scanning lines of the second group to perform the threshold correction during both the first half and the second half of the given frame period.

11. The display unit of claim 10, wherein each of the plurality of pixel circuits includes:

a display element, a first transistor configured to sample a potential carried on one of the plurality of signal lines when a scanning pulse is applied to one of the plurality of write scanning lines, which is connected to the first transistor, a capacitor with a first terminal configured to hold the potential sampled by the first transistor, and a second transistor configured to supply a drive current to the display element, the magnitude of the drive current corresponding to a voltage between the first terminal of the capacitor and a second terminal of the capacitor.

12. The display unit of claim 11, wherein the plurality of pixel circuits are configured to perform, under control of the drive control circuitry, a threshold correction operation that results in storing a threshold voltage of the second transistor of the respective one of the plurality of pixel circuit in the capacitor of the respective one of the plurality of pixel circuit.

13. The display unit of claim 12, wherein the drive control circuitry is configured to cause a given pixel circuit of the plurality of pixel circuits to perform the threshold correction operation by causing the first transistor of the given pixel circuit to be in a conductive state while a reference potential is carried on the signal line connected to the given pixel circuit and while a drive voltage is applied to the second transistor of the given pixel circuit.

14. The display unit of claim 13, wherein the threshold correction operation is performed simultaneously for all of those of the plurality of pixel circuits disposed in a same row.

15. The display unit of claim 11, wherein during a first half of the given frame period, in which video signal potentials corresponding to the first sub-frame are carried on the signal lines, for each of the pairs of pixel circuits, only one of the pixel circuits included in the respective pair of pixel circuits samples a video signal potential corresponding to a display gradation, and during a second half of the given frame period, in which video signal potentials corresponding to the second sub-frame are carried on the signal lines, for each of the pairs of pixel circuits, the one of the pixel circuits included in the respective pair of pixel circuits that did not sample a video signal potential corresponding to a display gradation during the first half of the given frame period samples a video signal potential corresponding to a display gradation.

16. The display unit of claim 15, wherein those of the plurality of pixel circuits connected to scanning lines of the first group sample video signal potential corresponding to display gradations during the first half of the given frame period, and those of the plurality of pixel circuits connected to scanning lines of the second group sample video signal potential corresponding to display gradations during the second half of the given frame period.

17. The display unit of claim 10, wherein only those of the plurality of pixel circuits that are connected to one of the write scanning lines of the first group are caused to display during a first part of a given frame period, and only those of the plurality of pixel circuits that are connected to one of the write scanning lines of the second group are caused to display during a second part of the given frame period.

* * * * *